US010987642B1

(12) United States Patent
Smith et al.

(10) Patent No.: US 10,987,642 B1
(45) Date of Patent: Apr. 27, 2021

(54) CUSTODY TRANSFER MIXING APPARATUS

(71) Applicant: Komax Systems, Inc., Huntington Beach, CA (US)

(72) Inventors: Robert Smith, Seal Beach, CA (US); Nolan Smith, Hermosa Beach, CA (US)

(73) Assignee: Komax Systems, Inc., Huntington Beach, CA (US)

( * ) Notice: Subject to any disclaimer, the term of this patent is extended or adjusted under 35 U.S.C. 154(b) by 214 days.

(21) Appl. No.: 15/617,840

(22) Filed: Jun. 8, 2017

(51) Int. Cl.
*B01F 5/06* (2006.01)

(52) U.S. Cl.
CPC .... *B01F 5/0616* (2013.01); *B01F 2005/0637* (2013.01)

(58) Field of Classification Search
CPC ..... B01F 5/0616; B01F 5/0617
See application file for complete search history.

(56) References Cited

U.S. PATENT DOCUMENTS 8,136,980 B2 * 3/2012 Smith ..... G01F 15/00 366/337
9,242,214 B2 * 1/2016 Pappalardo ..... B01F 5/0617
9,724,653 B2 * 8/2017 Pappalardo ..... B01F 5/0606

* cited by examiner

*Primary Examiner* — Elizabeth Insler
(74) *Attorney, Agent, or Firm* — Bay Area Technology Law Group PC

(57) ABSTRACT

An element for use in stationary material mixing and distribution. The element has an element longitudinal axis and a web positioned along the element longitudinal axis. A ramp is connected to a first end of the web and oriented diagonally thereto. A diverter is positioned on a first side of the web and a diverter is positioned on a second side of the web. First and second ears are bent respectively in upward and downward directions relative to the longitudinal axis. A rectangular member whose plane of orientation is substantially perpendicular to the web is provided as well as a third ear in the plane of orientation of the rectangular member extending from the rectangular member to the web.

13 Claims, 2 Drawing Sheets

CUSTODY TRANSFER MIXING APPARATUS

TECHNICAL FIELD

The present invention relates generally to material distributing and mixing apparatus and particularly to stationary material distribution and mixing apparatus which can be installed within a suitable conduit carrying fluids to be mixed on site as well as a method for employing the stationary material distribution and mixing apparatus for the introduction and mixing of an additive into a moving fluid stream.

BACKGROUND OF THE INVENTION

Applicant has long ago recognized the desirability of providing a superior line of motionless mixers, that is, mixing elements which do not rely upon any moving parts to create and enhance the mixing operation. For example, in Applicant's U.S. Pat. No. 4,034,965, an invention was disclosed in the form of a motionless mixer created from a plurality of self-nesting, abutting and axially overlapping elements fitted within a conduit. Such elements were found to be capable of not only mixing two or more unlike materials but also of redistributing a single material for thermal or other purposes. Such elements were shown to be capable of fitting into a conduit carrying fluids to be mixed and was shown to be inexpensive to fabricate. Regarding this latter issue, the elements could be punch pressed from flat sheets. The invention of the '965 patent included a mixing element having a central flat portion, the plane of which was intended to be generally aligned with the longitudinal axis of the conduit in which it was placed. First and second ears, being rounded, fit to the wall of the conduit being bent upwardly and downwardly from the flat portion. Various elements were taught to stack or "nest" with respect to one another such that material moving longitudinally within the conduit experiences a velocity or rotational vector imposed by the ears of the mixing element. The flat portion transforms the rotational vector to a lateral or radial vector. Subsequent to the flat portion, ears impose a further velocity vector adding somewhat to the lateral or radial vector. Such devices have been employed for mixing and distributing all types of materials including liquids, solids, gases, foams and the like. Because various "nested" elements were not permanently fastened to each other or to the inner wall of the conduit, the conduit could be a flexible material so that the apparatus could take various curved shapes as may be required in a particular application.

Even though the material distributing and mixing apparatus as disclosed in the'965 patent represented a breakthrough in material distribution and mixing, certain drawbacks were recognized in the use of such apparatus which have be addressed in later designs. For example, the replaceable mixing elements made the subject of Applicant's U.S. Pat. No. 7,137,731 terminated in a substantially rectangular member whose plane of orientation was substantially perpendicular to the central portion of the mixing elements in order to aid in minimizing "barber poling" resulting from the influence that the ears of the mixing elements imposed upon a moving fluid. Other improvements have been made as well over time.

Applicant has also created mixing elements which offer superior results in unique applications. For example, it is crucial that mixing and redistribution of fluids takes place upstream of the sampling point in a crude oil transfer line. It is critical that bottom sediment and water be thoroughly dispersed throughout the crude oil stream prior to the sampling point over a wide flow range to enable an automatic sampler to take a truly representative sample, all within conduits of 14 inches or greater in diameter. Further, such mixing elements, referred to as Custody Transfer Mixers, to work effectively, must be capable of being installed in a horizontal or vertical pipe line. Although Applicants provided adequate Custody Transfer Mixers in the past which are capable of creating internal vortices such as those created when employing the mixers of Applicant's '965 patent, the need for accurate mixing within large pipe diameters when dealing with crude oil transfer lines drove the need for improved solutions.

It is thus an object to the present invention to provide a stationary material mixing and distribution device capable of mixing and redistributing fluids upstream of a sampling point in a crude oil transfer line more effectively than similar products that previously exist.

It is yet another object of the present invention to provide a stationary material mixing and distribution device designed to deal with immiscible fluids, such as oil and water, capable of directing heavier fluids to the center of a conduit for greater mixing efficiency. These and further objects will be readily apparent when considering the following disclosure and appended claims.

SUMMARY OF THE INVENTION

An element for use in stationary material mixing and distribution, said element having an element longitudinal axis and comprising a web positioned along said element longitudinal axis, a ramp connected to a first end of said web and oriented diagonally thereto, a diverter positioned on a first side of said web and a diverter positioned on a second side of said web, first and second ears bent respectively in upward and downward directions relative to said longitudinal axis, a rectangular member positioned at a second end of said web whose plane of orientation is substantially perpendicular to said web and a third ear in the plane of orientation of said rectangular member and extending from said rectangular member to said web.

A stationary material mixing and distribution device comprising a conduit, said conduit having a fluid inlet and fluid outlet, an inner wall over which fluids flow within said conduit, a substantially circular cross-section and a conduit longitudinal axis, an element having an element longitudinal axis and comprising a web positioned along said element longitudinal axis, a ramp connected to a first end of said web and oriented diagonally thereto, a diverter positioned on a first side of said web and a diverter positioned on a second side of said web, first and second ears bent respectively in upward and downward directions relative to said longitudinal axis, a rectangular member positioned at a second end of said web whose plane of orientation is substantially perpendicular to said web and a third ear in the plane of orientation of said rectangular member and extending from said rectangular member to said web, said mixing element being positioned within said conduit between said fluid inlet and fluid outlet.

A method of mixing and distributing fluids within a moving fluid stream passing within a conduit, said conduit having a fluid inlet and fluid outlet, an inner wall over which fluids flow within said conduit, a substantially circular cross-section and a conduit longitudinal axis, an element having an element longitudinal axis and comprising a web positioned along said element longitudinal axis, a ramp connected to a first end of said web and oriented diagonally thereto, a diverter positioned on a first side of said web and a diverter positioned on a second side of said web, first and second ears bent respectively in upward and downward directions relative to said longitudinal axis, a rectangular member positioned at a second end of said web whose plane of orientation is substantially perpendicular to said web and a third ear in the plane of orientation of said rectangular member and extending from said rectangular member to said web, said mixing element being positioned within said conduit between said fluid inlet and fluid outlet and passing fluids to be mixed from said fluid inlet to said fluid outlet over said element.

DETAILED DESCRIPTION OF THE INVENTION

Figure 1:
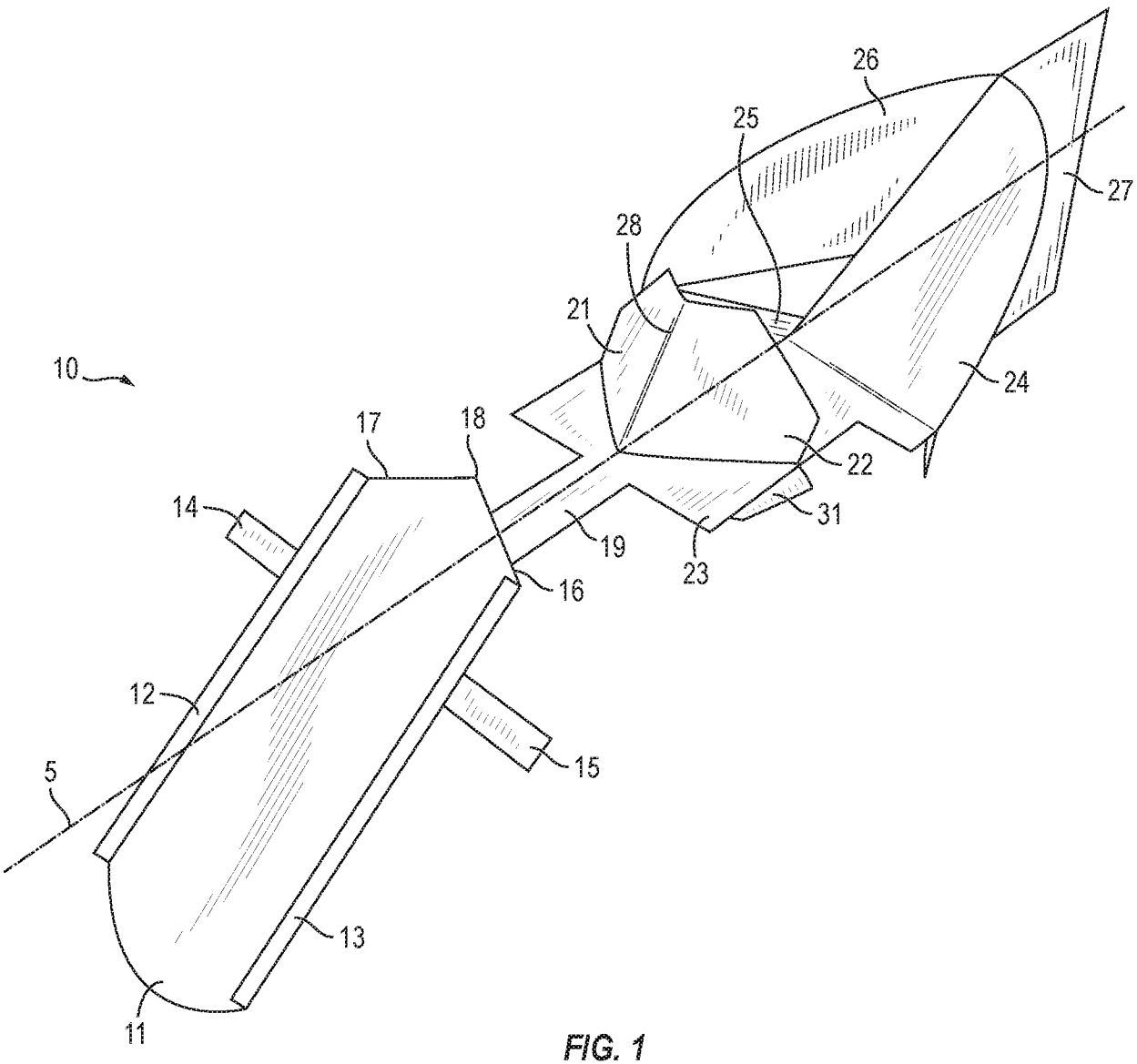
FIG. 1 is a perspective view of the mixing element of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof.

Figure 2:
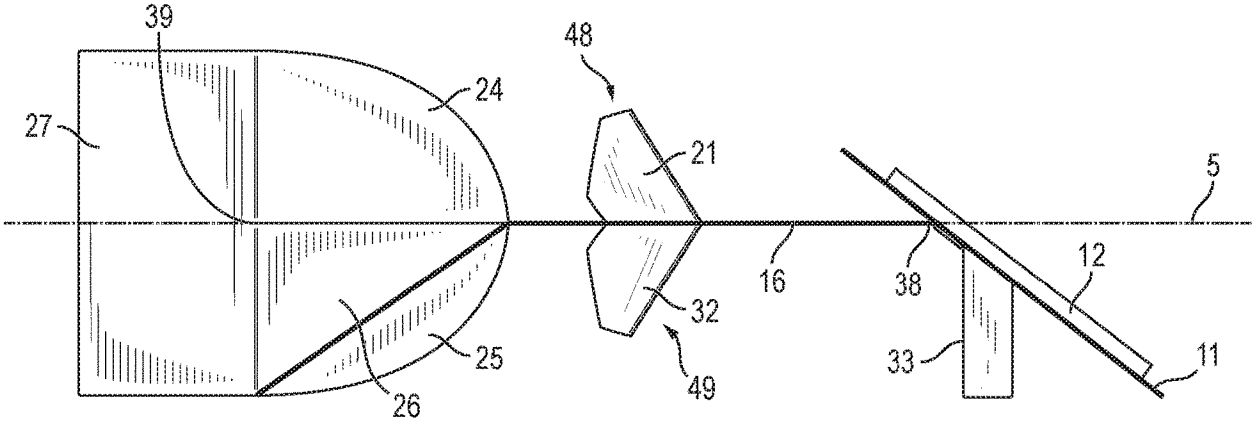
FIG. 2 is a side view of the mixing element of FIG. 1.

Turning first to FIGS. 1 and 2, the present element for use in a stationary material mixing and distribution device is shown. Specifically, element 10 is characterized as having web 16 extending from first end 38 to second end 39 along element longitudinal axis 5. Ramp 11 is positioned along element longitudinal axis 5 being connected to first end 38 and oriented diagonally thereto, generally at approximately 30° to element longitudinal axis 5. Ramp 11 is intended to direct a heavier fluid in an immiscible fluid stream to the center of the conduit housing element 10 for great mixing efficiency and is further characterized as having side rails 12 and 13 which act to direct fluids flowing over element 10 diagonally as provided by ramp 11. As noted particularly from FIG. 1, web 16, in moving away from first end 38 expands from relatively narrow web and 19 to expanded platform 23.

Platform 23 acts to support diverter 48 positioned on a first side of expanded platform 23 and oriented diagonally thereto and second diverter 49 positioned on a second side of expanded platform and again oriented diagonally thereto. Each of the diverters comprise a pair of substantially rectangular legs 21, 22, 31 and 32 forming the diverters each of which meet at an apex (FIG. 1 illustrating apex 28), each apex being oriented toward first and 38 of web 16.

In moving toward second end 39 of web 16, element 10 is further provided with first and second ears 24 and 25 bent respectively in upward and downward directions relative to longitudinal axis 5. Rectangular member 27 whose plane of orientation is substantially perpendicular to web 16 terminates element 10 noting further that third ear 26 in the plane of orientation of rectangular member 27 extends from rectangular member 27 to web 16.

Figure 3:
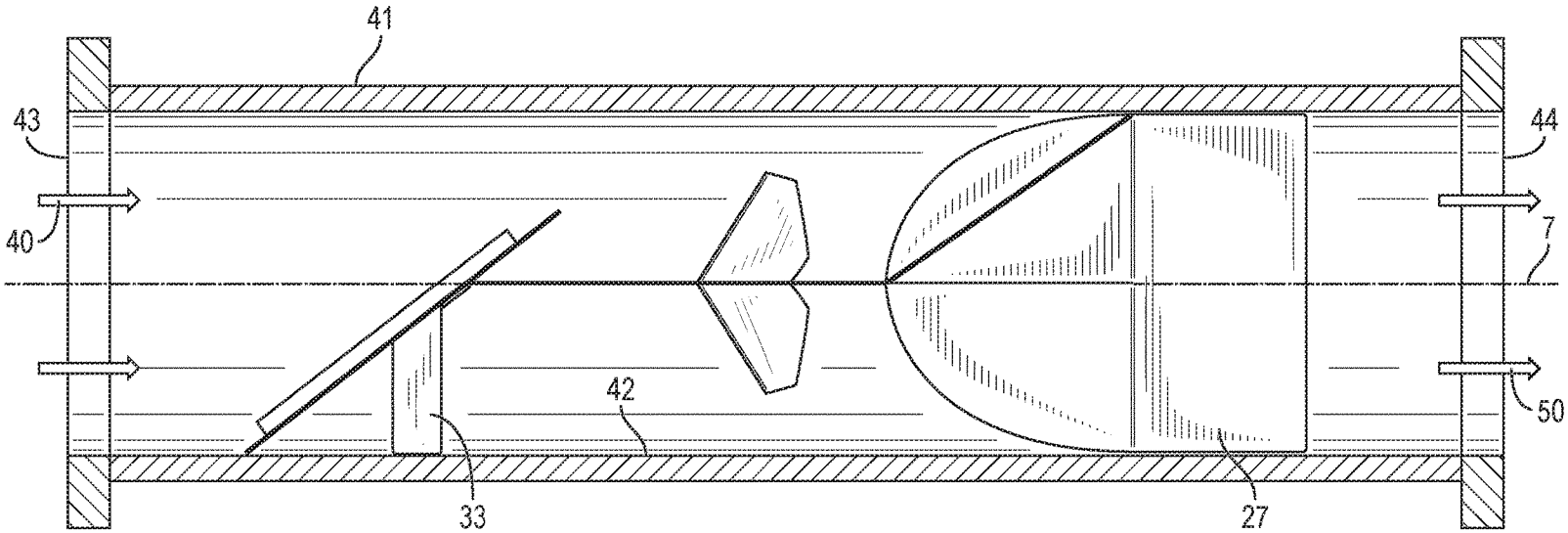
FIG. 3 is a cutaway side view of the mixing element of FIG. 1 positioned within a conduit for carrying out the present mixing method.

Element 10 is further provided with stabilizers 14, 15 and 33, the purpose of which will be more readily appreciated in reference to FIG. 3.

In turning to FIG. 3, conduit 41 is shown having fluid inlet or upstream end 43 and fluid outlet or downstream end 44, the conduit characterized as having a substantially circular cross-section and a conduit longitudinal axis 7. Fluid enters conduit 41 at fluid inlet 43 in the direction of arrows 40 and exits conduit 41 at fluid exit 44 in the directions of arrows 50. Between first end 43 and second end 44 is positioned element 10 noting that element longitudinal axis 5 aligns with conduit longitudinal axis 7, first end 38 of web 16 faces fluid inlet 43 and second end 39 of web 16 faces fluid outlet 44. In doing so, stabilizers 33, 14 and 15 abut inner wall 42 of conduit 41 in order to stabilize mixing element 10 therein. To further stabilize element 10 within conduit 41 and to appropriately aid in the mixing of fluids passing there through, rectangular member 27 is sized to also abut inner wall 42 as shown. Rectangular member 27 cancels the angular rotation of fluid passing within a conduit 41 to substantially eliminate violent rotation of the fluid stream which would cause centrifuging of the fluids to occur. Typically, an automatic sampler is located two to four pipe diameters downstream of element 10 resulting in highly reliable net crude oil measurements.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A stationary material mixing and distribution device comprising a conduit, said conduit having a fluid inlet and fluid outlet, an inner wall over which fluids flow within said conduit, a substantially circular cross-section and a conduit longitudinal axis, said stationary material mixing and distribution device having longitudinal axis and a web positioned along said longitudinal axis, a singular planar ramp proximate said fluid inlet connected to a first end of said web and oriented diagonally thereto, a diverter positioned on a first side of said web downstream of said ramp and a diverter positioned on a second side of said web downstream of said ramp, first and second ears bent respectively in upward and downward directions relative to said longitudinal axis and positioned downstream of said diverters, a rectangular member positioned at a second end of said web downstream of said first and second ears whose plane of orientation is substantially perpendicular to said web and a third ear in the plane of orientation of said rectangular member and extending from said rectangular member to said web, said stationary material mixing and distribution device being positioned within said conduit between said fluid inlet and fluid outlet.

2. The stationary material mixing and distribution device of claim 1 wherein said stationary material mixing and distribution device longitudinal axis aligns with said conduit longitudinal axis.

3. The stationary material mixing and distribution device of claim 2 further comprising a plurality of stabilizers wherein said mixing element is fitted within said conduit such that said plurality of stabilizers extend from said ramp and contact said inner wall.

4. The stationary material mixing and distribution device of claim 2 wherein said first end of said web faces said fluid inlet and said second end of said web faces said fluid outlet.

5. The stationary material mixing apparatus of claim 1 wherein said ramp further comprises linear side rails.

6. The stationary material mixing apparatus of claim 1 wherein said ramp is angled approximately 30° to said stationary material mixing and distribution device longitudinal axis.

7. The stationary material mixing apparatus of claim 1 wherein said diverters each comprise a pair of substantially rectangular legs which meet at an apex oriented toward the first end of said web.

8. The stationary material mixing and distribution device of claim 1 wherein said web expands downstream of said ramp forming a platform, said platform supporting said diverters.

9. The stationary material mixing and distribution device of claim 1 wherein said rectangular member is sized to abut said inner wall of said conduit.

10. A stationary material mixing and distribution device comprising a conduit, said conduit having a fluid inlet and fluid outlet, an inner wall over which fluids flow within said conduit, a substantially circular cross-section and a conduit longitudinal axis, said stationary material mixing and distribution device having longitudinal axis and comprising a web positioned along said longitudinal axis, a singular planar ramp having side rails being proximate said fluid inlet and connected to a first end of said web and oriented approximately 30° diagonally thereto, a diverter positioned on a first side of said web downstream of said ramp and a diverter positioned on a second side of said web downstream of said ramp, first and second ears bent respectively in upward and downward directions relative to said longitudinal axis and positioned downstream of said diverters, a rectangular member positioned at a second end of said web downstream of said first and second ears whose plane of orientation is substantially perpendicular to said web and a third ear in the plane of orientation of said rectangular member and extending from said rectangular member to said web, said stationary material mixing and distribution device being positioned within said conduit and further comprising a plurality of stabilizers wherein said stationary material mixing and distribution device is fitted within said conduit such that said plurality of stabilizers extend from said ramp in contact with said inner wall.

11. The stationary material mixing and distribution device of claim 10 wherein said diverters each comprise a pair of substantially rectangular legs which meet at an apex oriented toward the first end of said web.

12. The stationary material mixing and distribution device of claim 10 wherein said web expands downstream of said ramp forming a platform, said platform supporting said diverters.

13. The stationary material mixing and distribution device of claim 10 wherein said rectangular member is sized to abut said inner wall of said conduit.

* * * * *